US011325270B2

(12) United States Patent
Griffin et al.

(10) Patent No.: US 11,325,270 B2
(45) **Date of Patent: *May 10, 2022**

(54) METAL SPRING RETURN AND METHOD

(71) Applicant: SHAVELOGIC, INC., Plano, TX (US)

(72) Inventors: John W. Griffin, Moultonborough, NH (US); Craig A. Provost, Boston, MA (US); William E. Tucker, Attleboro, MA (US); Aaron G. Cantrell, Northampton, MA (US)

(73) Assignee: SL IP COMPANY LLC, Dallas, TX (US)

( * ) Notice: Subject to any disclaimer, the term of this patent is extended or adjusted under 35 U.S.C. 154(b) by 253 days.

This patent is subject to a terminal disclaimer.

(21) Appl. No.: 15/120,222

(22) PCT Filed: Mar. 13, 2015

(86) PCT No.: PCT/US2015/020538

§ 371 (c)(1),
(2) Date: Aug. 19, 2016

(87) PCT Pub. No.: WO2015/142663

PCT Pub. Date: Sep. 24, 2015

(65) Prior Publication Data

US 2017/0080585 A1 Mar. 23, 2017

Related U.S. Application Data

(60) Provisional application No. 61/968,689, filed on Mar. 21, 2014.

(51) Int. Cl.

| | |
|---|---|
| ***B26B 21/52*** | (2006.01) |
| ***B26B 21/22*** | (2006.01) |
| ***B26B 21/40*** | (2006.01) |

(52) U.S. Cl.
CPC ..... *B26B 21/521* (2013.01); *B26B 21/225* (2013.01); *B26B 21/4081* (2013.01); *Y10T 83/04* (2015.04)

(58) Field of Classification Search
CPC .. B26B 21/225; B26B 21/521; B26B 21/4081
(Continued)

(56) References Cited

U.S. PATENT DOCUMENTS

| | | | |
|---|---|---|---|
| 996,879 | A | 7/1911 | Odell |
| 1,015,575 | A | 1/1912 | Felix |

(Continued)

FOREIGN PATENT DOCUMENTS

| | | |
|---|---|---|
| EP | 0951971 A1 | 10/1999 |
| EP | 1245351 | 10/2002 |

(Continued)

OTHER PUBLICATIONS

International Search Report/Written Opinion—PCT Application No. PCT/US2015/20538, dated Jun. 24, 2015, 8 pages.

(Continued)

*Primary Examiner* — Clark F Dexter
(74) *Attorney, Agent, or Firm* — Leber IP Law; Celia H. Leber

(57) ABSTRACT

A replaceable shaving assembly including a blade unit and an interface element configured to removeably connect the blade unit to a handle, on which the blade unit is pivotably mounted, the interface element including a return element configured to provide a return force between the blade unit and handle, the return element including a metal leaf spring.

16 Claims, 12 Drawing Sheets

(58) Field of Classification Search
USPC ..... 30/527, 534
See application file for complete search history.

(56) References Cited

U.S. PATENT DOCUMENTS 1,074,615 A 10/1913 Folmer
1,498,155 A 6/1924 Dorr
1,822,766 A * 9/1931 Duffy ..... B26B 21/12 30/31
2,406,983 A * 9/1946 Anderson ..... B26B 21/52 30/534
2,406,985 A * 9/1946 Anderson ..... B26B 21/18 30/534
3,311,975 A 4/1967 De Longuyon
3,593,416 A 7/1971 Edson
3,709,517 A 1/1973 Wossner
3,768,348 A 10/1973 Braun et al.
3,938,247 A 2/1976 Carbonell et al.
4,094,063 A * 6/1978 Trotta ..... B26B 21/521 30/47
4,198,746 A * 4/1980 Trotta ..... B26B 21/225 30/29
4,347,663 A 9/1982 Ullmo
4,403,414 A 9/1983 Kiraly et al.
4,475,286 A 10/1984 Saito
4,774,765 A 10/1988 Ferraro
4,785,534 A 11/1988 Lazarchik
4,834,760 A 5/1989 Richter, Jr.
4,838,564 A 6/1989 Jarvis
4,850,518 A 7/1989 Salmon et al.
4,970,784 A 11/1990 Althaus et al.
5,029,391 A 7/1991 Althaus et al.
5,074,042 A 12/1991 Althaus et al.
5,168,628 A 12/1992 Mock et al.
5,219,468 A 6/1993 Olson
5,369,885 A 12/1994 Ferraro
5,402,574 A 4/1995 Milner
5,466,901 A 11/1995 Mochizuki
5,533,263 A 7/1996 Gilder
5,551,153 A 9/1996 Simms
5,551,717 A 9/1996 De Courcey Milne
5,560,106 A 10/1996 Armbruster et al.
5,645,603 A 7/1997 Peters
5,661,907 A 9/1997 Apprille, Jr.
5,669,139 A 9/1997 Oldroyd et al.
5,678,316 A 10/1997 Althaus et al.
5,771,591 A 6/1998 Armbruster et al.
5,794,342 A 8/1998 Davey
5,813,293 A 9/1998 Apprille et al.
5,855,071 A 1/1999 Apprille, Jr. et al.
5,890,296 A 4/1999 Metcalf et al.
6,014,918 A 1/2000 Orloff
6,112,412 A 9/2000 Richard
6,122,826 A * 9/2000 Coffin et al. ..... B26B 21/521 30/527
6,138,361 A 10/2000 Richard et al.
6,145,201 A 11/2000 Andrews
6,161,287 A 12/2000 Swanson et al.
6,182,366 B1 2/2001 Richard
6,216,345 B1 4/2001 Andrews
6,223,442 B1 5/2001 Pina
6,311,400 B1 11/2001 Hawes et al.
6,357,118 B1 3/2002 Eichhorn et al.
6,502,318 B1 1/2003 Gilder
6,557,265 B2 5/2003 Coffin
6,560,881 B2 5/2003 Coffin
6,612,040 B2 9/2003 Gilder
6,615,498 B1 9/2003 King et al.
6,637,113 B2 10/2003 Ikuta et al.
6,655,028 B2 12/2003 Coffin
6,772,523 B1 8/2004 Richard et al.
6,807,739 B2 10/2004 Follo
6,851,190 B2 2/2005 Guimont et al.
6,854,188 B1 2/2005 Wonderley
6,880,253 B1 * 4/2005 Gyllerstrom ..... B26B 21/14 30/50
6,973,730 B2 12/2005 Tomassetti et al.
6,990,740 B2 1/2006 Follo et al.
6,996,908 B2 2/2006 Orloff et al.
6,997,446 B2 2/2006 Hall et al.
7,028,405 B2 4/2006 Paas et al.
7,086,160 B2 8/2006 Coffin et al.
7,100,284 B2 9/2006 King
7,103,976 B2 9/2006 Pennella
7,152,512 B1 12/2006 Prochaska
7,266,895 B2 9/2007 Pennella et al.
7,370,419 B2 5/2008 Coffin et al.
7,441,336 B2 10/2008 Hawes et al.
7,461,458 B2 12/2008 Peyser et al.
7,510,345 B2 3/2009 Kosh et al.
7,574,809 B2 8/2009 Follo et al.
7,669,511 B2 3/2010 King
7,784,504 B2 8/2010 Freed et al.
7,797,834 B2 9/2010 Steunenberg et al.
7,802,368 B2 9/2010 Coffin et al.
7,877,879 B2 2/2011 Nakasuka
7,913,393 B2 3/2011 Royle et al.
8,033,023 B2 10/2011 Johnson et al.
8,079,147 B2 12/2011 Wonderley
8,096,054 B2 1/2012 Denkert et al.
8,166,661 B2 5/2012 King
8,205,343 B2 6/2012 Winter et al.
8,205,344 B2 6/2012 Stevens
8,234,761 B2 8/2012 Gompert et al.
8,273,205 B2 9/2012 Murgida
8,307,552 B1 11/2012 Drouillard
8,359,751 B2 1/2013 Efthimiadis et al.
8,479,398 B2 7/2013 Coresh
8,484,852 B2 7/2013 King
8,499,459 B2 8/2013 Efthimiadis et al.
8,590,162 B2 11/2013 Park et al.
8,640,342 B2 2/2014 Murgida
8,732,955 B2 5/2014 Howell et al.
8,746,223 B2 6/2014 Jones
8,769,825 B2 7/2014 Howell et al.
8,789,282 B2 7/2014 Wilson et al.
8,793,880 B2 8/2014 Taub et al.
8,844,145 B2 9/2014 Psimadas et al.
8,869,781 B2 10/2014 Jones
8,967,130 B2 3/2015 Victor et al.
9,469,038 B2 10/2016 Iaccarino et al.
9,475,202 B2 * 10/2016 Griffin et al. ..... B26B 21/225
9,486,930 B2 11/2016 Provost et al.
9,579,809 B2 2/2017 Hawes
9,623,575 B2 * 4/2017 Griffin et al. ..... B26B 21/521
9,630,331 B2 * 4/2017 Griffin et al. ..... B26B 21/4081
9,676,108 B2 6/2017 Beugels et al.
9,694,503 B2 7/2017 Papadopoulos-Papageorgis et al.
9,701,034 B2 7/2017 Papadopoulos-Papageorgis et al.
9,757,870 B2 9/2017 Giannopoulos et al.
9,895,817 B2 2/2018 Georgakis et al.
9,902,077 B2 2/2018 Park et al.
10,022,882 B2 * 7/2018 Griffin et al. ..... B26B 21/521
10,391,654 B2 * 8/2019 Griffin et al. ..... B05D 7/02
10,500,747 B2 * 12/2019 Tucker et al. ..... B26B 21/4068
10,967,533 B2 * 4/2021 Griffin et al. ..... B05D 7/02
2002/0138992 A1 10/2002 Richard
2003/0046819 A1 3/2003 Ferraro et al.
2004/0177519 A1 9/2004 Tomassetti et al.
2005/0039338 A1 2/2005 King et al.
2005/0278954 A1 12/2005 Orloff et al.
2006/0080837 A1 4/2006 Johnson et al.
2007/0283566 A1 12/2007 Blatter et al.
2008/0155831 A1 7/2008 Royle
2008/0189964 A1 8/2008 Bozikis et al.
2008/0196251 A1 8/2008 Royle
2009/0000126 A1 1/2009 Kraus
2009/0038167 A1 2/2009 Peyser et al.
2009/0260238 A1 * 10/2009 Nakasuka ..... B26B 21/225 30/527
2010/0132204 A1 * 6/2010 Brown ..... B26B 21/225 30/527
2011/0016724 A1 1/2011 Murgida

(56) References Cited

U.S. PATENT DOCUMENTS

| | | | | |
|---|---|---|---|---|
| 2011/0088269 | A1* | 4/2011 | Walker, Jr. et al. | B26B 21/225 30/527 |
| 2011/0247217 | A1 | 10/2011 | Johnson et al. | |
| 2012/0210586 | A1 | 8/2012 | Lelieveld et al. | |
| 2012/0297625 | A1 | 11/2012 | Madden | |
| 2013/0081289 | A1 | 4/2013 | Wain et al. | |
| 2014/0026726 | A1 | 1/2014 | Griffin et al. | |
| 2014/0109735 | A1* | 4/2014 | Shepperson | B26B 21/521 83/13 |
| 2015/0158192 | A1* | 6/2015 | Tucker et al. | B26B 21/225 83/13 |
| 2015/0190936 | A1* | 7/2015 | Griffin et al. | B26B 21/225 132/200 |
| 2015/0290819 | A1* | 10/2015 | Giannopoulos et al. | B26B 21/222 30/532 |
| 2017/0036360 | A1 | 2/2017 | Griffin et al. | |
| 2017/0182672 | A1 | 6/2017 | Griffin et al. | |

FOREIGN PATENT DOCUMENTS

| | | | |
|---|---|---|---|
| EP | 1488894 | | 12/2004 |
| EP | 2123410 | | 11/2009 |
| GB | 1460732 | | 1/1977 |
| GB | 2030909 | | 4/1980 |
| WO | 2006127435 | | 11/2006 |
| WO | 2010022192 | | 2/2010 |
| WO | 2012158143 | | 11/2012 |
| WO | 2014051843 | | 4/2014 |
| WO | 2014/094909 | * | 6/2014 |

OTHER PUBLICATIONS

Search Report—Corresponding European Patent Application No. 13840539, dated Apr. 25, 2016, 7 pages.

Search Report—Corresponding European Patent Application No. 13864593, dated Jul. 8, 2016, 7 pages.

European Patent Application No. 19192461.2 Extended European Search Report dated Dec. 4, 2019, 8 pages.

* cited by examiner

METAL SPRING RETURN AND METHOD

BACKGROUND

The invention relates to shaving systems having handles and replaceable blade units. Shaving systems often consist of a handle and a replaceable blade unit in which one or more blades are mounted in a plastic housing. Such shaving systems often include a pivoting attachment between the blade unit and handle, which allows the blade unit to maintain optimum contact with the surface being shaved. The pivoting attachment often includes a mechanism to provide resistance during shaving and return the blade unit to a neutral or "rest" position when it is not in contact with the user's skin.

SUMMARY

Generally, the present disclosure pertains to shaving systems and to replaceable shaving assemblies for use in such systems. The systems include a flexible return element. The flexible return element is a metal leaf spring, which provides resistance and return forces that are often provided by a pusher and follower mechanism in prior art shaving systems.

In one aspect, the invention features a replaceable shaving assembly comprising a blade unit and an interface element configured to removeably connect the blade unit to a handle, on which the blade unit is pivotably mounted. The interface element comprises a return element configured to provide a return force between the blade unit and handle, the return element comprising a metal leaf spring. A pivot stop may be formed integrally with the blade unit.

Some implementations may include one or more of the following features. The return element may be configured to bias the blade unit towards a rest position with respect to a pivot axis that is generally parallel to a long axis of the blade unit. The return element may comprise a metal alloy. The return element may be formed from a sheet material having a thickness of from about 0.05 to 4.0 mm. The return element may be generally U-shaped. A base portion of the U-shape may be configured to engage a surface of the blade unit.

The interface element may comprise a substantially rigid portion defining a cavity configured to receive a distal end of the handle. The interface element may include receiving openings and the return element may include mounting tabs disposed in the receiving openings.

The return element may be configured to bend upon rotation of the blade unit toward an upper surface of the handle. The interface element may comprise pivot elements that may be configured to be received by corresponding elements on the blade unit.

In another aspect, the invention features a shaving system that comprises a handle having a distal end and a proximal end and a shaving assembly, mounted on the distal end of the handle. The shaving assembly includes an interface element configured to connect the blade unit to the handle, and a blade unit pivotably mounted on the interface element. The interface element comprises a return element configured to provide a return force between the blade unit and handle, the return element comprising a metal leaf spring.

Some implementations may include one or more of the following features. The return element may be configured to bias the blade unit towards a rest position with respect to a pivot axis that is generally parallel to a long axis of the blade unit. The return element may comprise a metal alloy. The return element may be formed from a sheet material having a thickness of from about 0.05 mm to 4.0 mm. The interface element may comprise a substantially rigid portion defining a cavity configured to receive a distal end of the handle. The interface element may include receiving openings and the return element may include mounting tabs disposed in the receiving openings. The return element may be generally U-shaped. A base portion of the U-shape may be configured to engage a surface of the blade unit. The return element may be configured to bend upon rotation of the blade unit toward an upper surface of the handle. The interface element may comprise pivot elements that are configured to be received by corresponding elements on the blade unit. A pivot stop may be formed integrally with the blade unit.

The invention also features methods of shaving. For example, in one aspect the invention features a method of shaving comprising contacting the skin with the blade unit of a shaving system that includes a handle having a distal end and a proximal end, and pivotably mounted on the handle, a replaceable shaving assembly that includes a blade unit and an interface element configured to removeably connect the blade unit to the handle. The interface element comprises a return element configured to provide a return force between the blade unit and handle, the return element comprising a metal leaf spring.

DETAILED DESCRIPTION

Figure 1:
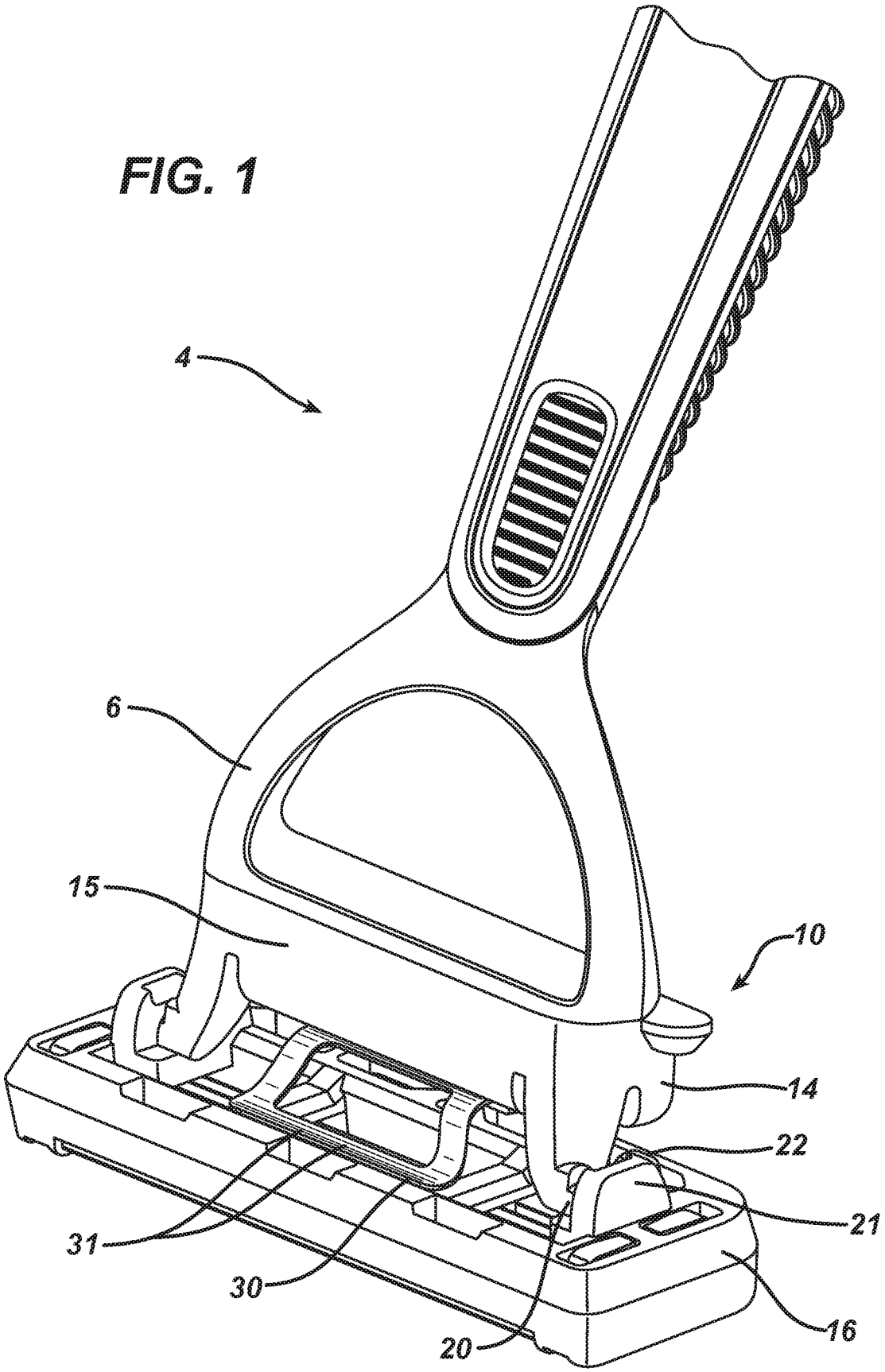
FIG. 1 is a perspective view of a shaving assembly according to one embodiment that includes a blade unit, an interface element, and a return element.

Shaving assemblies commonly include a handle and a replaceable blade unit. Referring to FIG. 1, a shaving system 4 includes a handle 6, an interface element 14, a return element 30, and a blade unit 16. Blade unit 16 includes a plurality of blades (not shown) and is pivotably mounted on the interface element. The interface element 14 includes a generally rigid body that defines a cavity 12 (FIG. 2) dimensioned to receive 15 the distal end of handle 6. Generally, the interface element 14, the return element 30, and the blade unit 16 are sold to the consumer as an integrated, replaceable shaving assembly 10. As shown in FIG. 1, the interface element 14 includes pivot elements 20 that are configured to be received by corresponding elements 21 on the blade unit 16 which further includes pivot stops 22 formed integrally with the blade unit.

Figure 2:
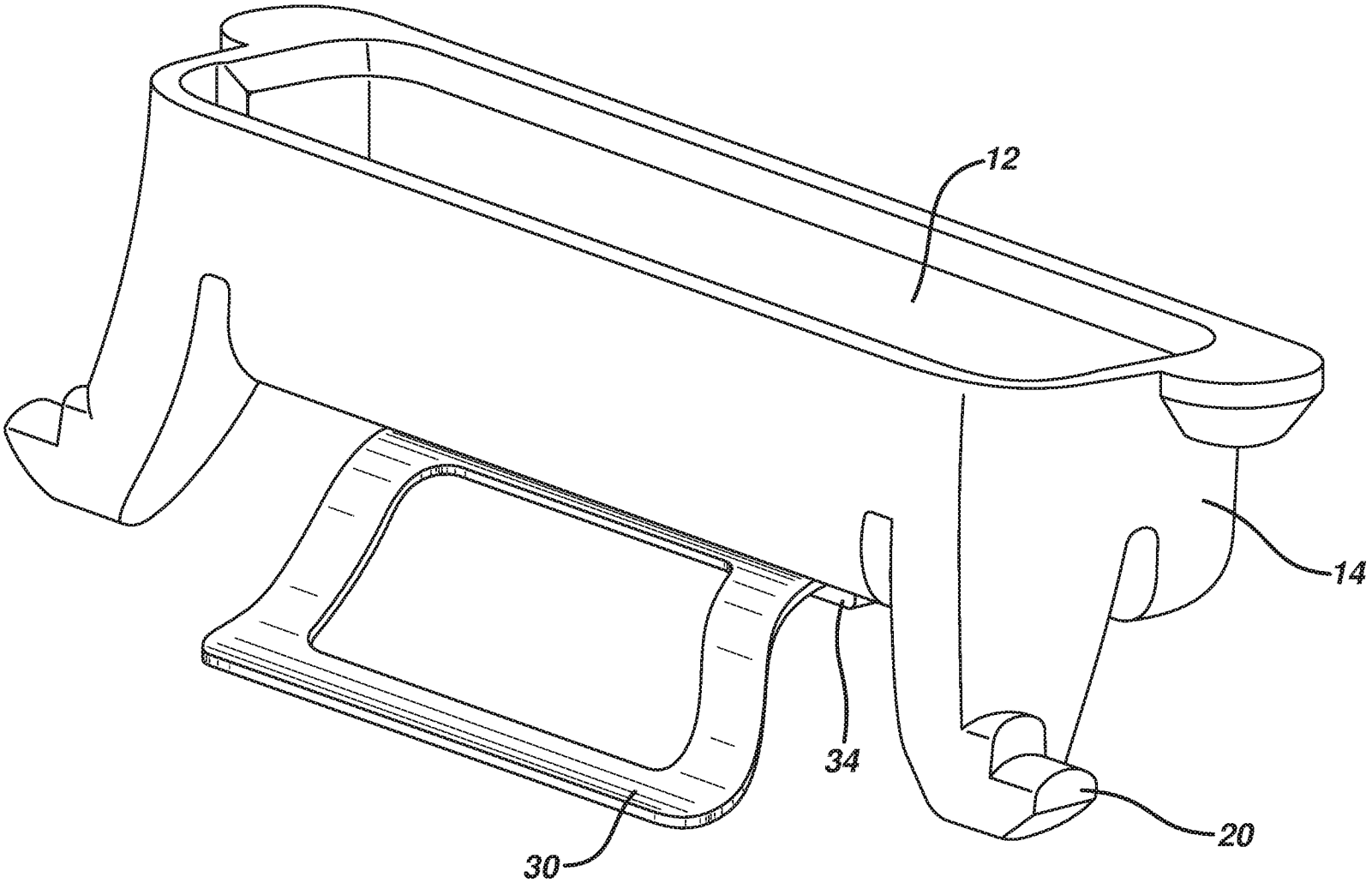
FIG. 2 is a perspective view of the interface element/return element assembly shown in FIG. 1.
Figure 3:
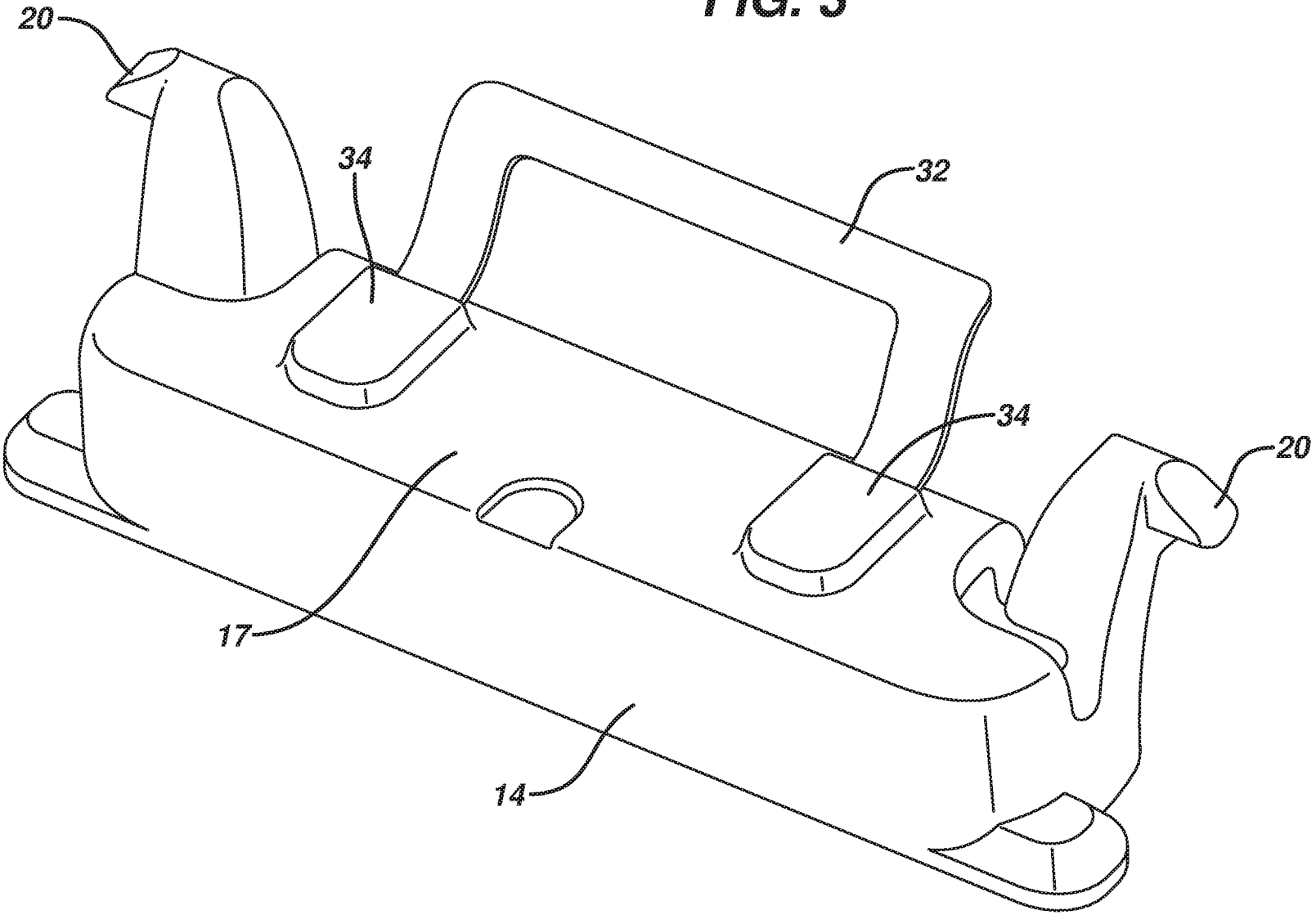
FIG. 3 is a perspective view of the underside of the assembly shown in FIG. 2.

Referring to FIGS. 2 and 3, the return element 30, which comprises a metal leaf spring, is mounted on interface element 14 and extends generally downwardly and outwardly from surface 17 of the interface element. The return element 30 includes a generally straight central portion 31 that is configured to engage the back surface of the blade unit (e.g., as shown in FIG. 1). The return element can be formed in a box shape as seen in FIG. 1. The box shape improves the torsional rigidity of the return element enhancing the manufacturability and assembly. Alternatively, the return element can be generally U-shaped, e.g. as shown in FIG. 5.

Figure 7:
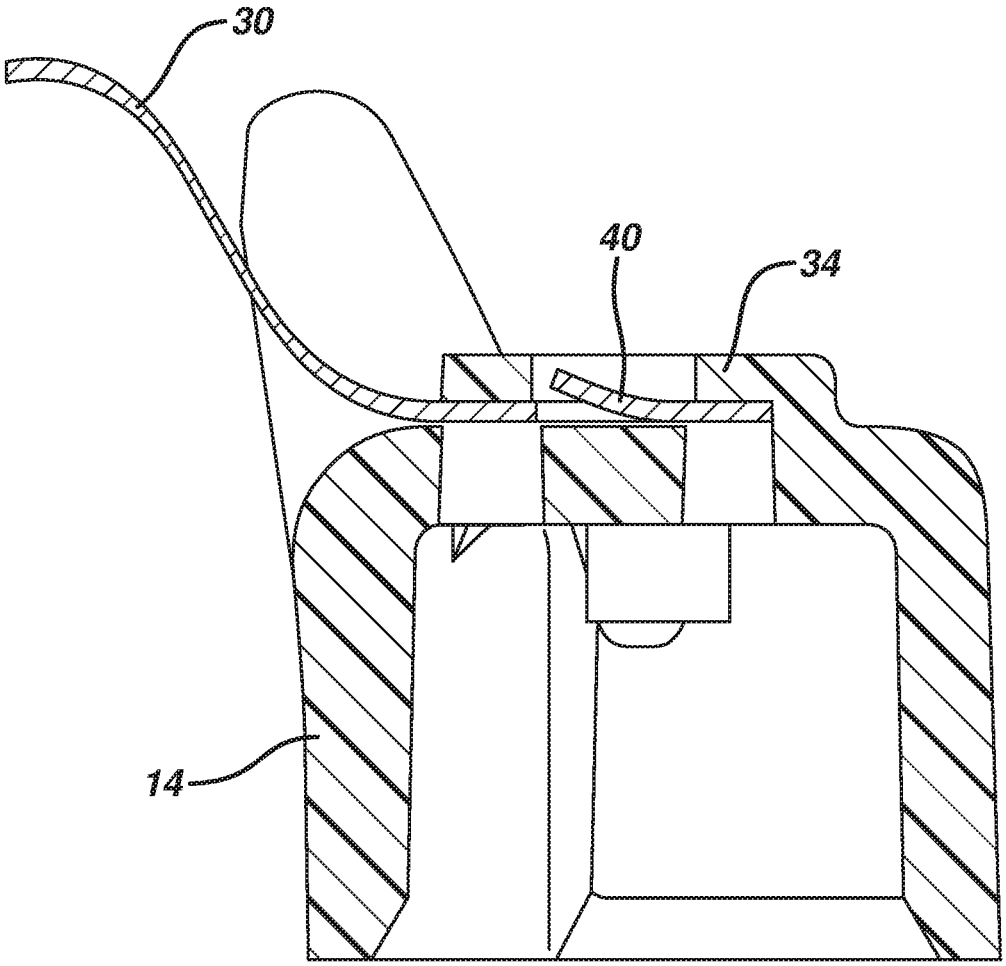
FIG. 7 is a sectional view of the assembly shown in FIG. 6 taken along line A-A.
Figure 10:
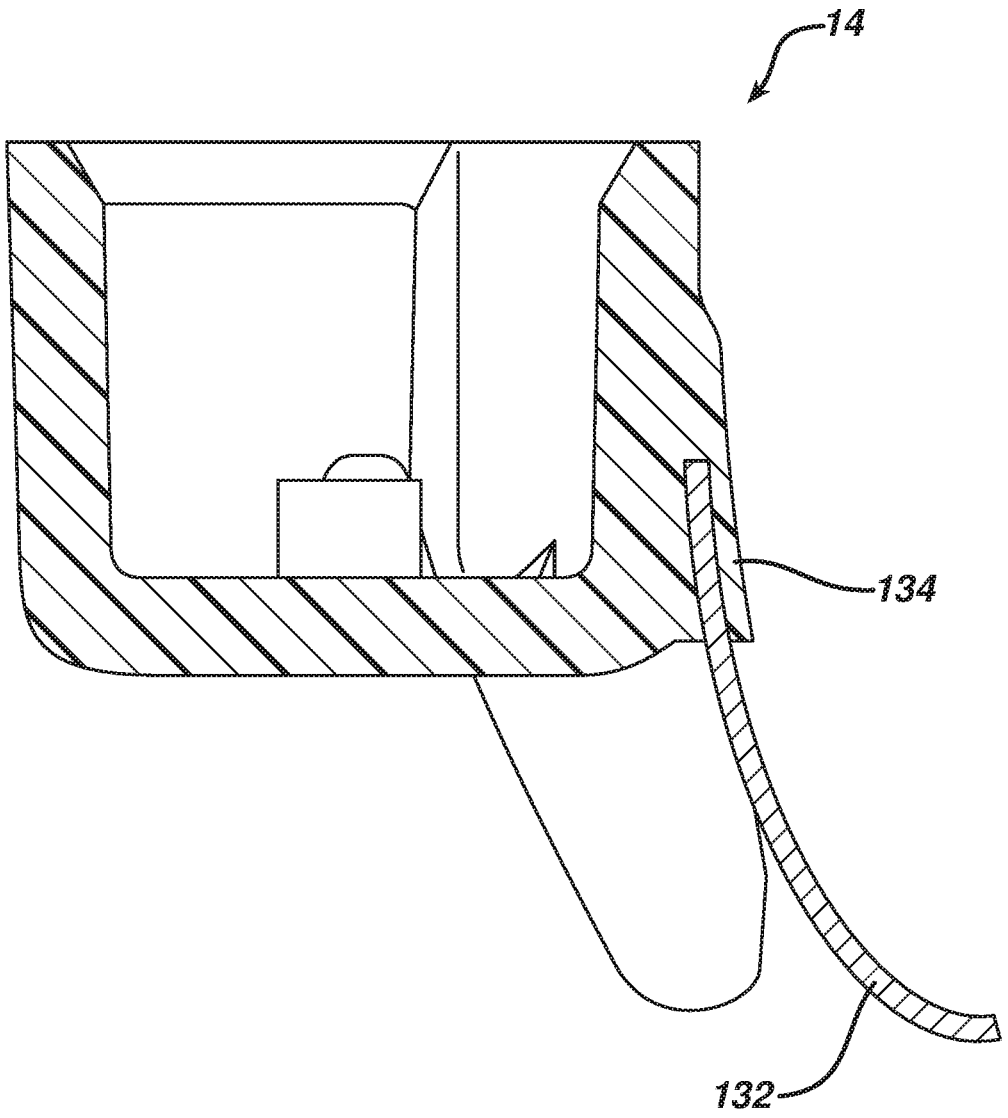
FIG. 10 is section view of the assembly shown in FIG. 9 taken along line B.

The return element may also have various shapes when seen from the side. For example, the side profile may define a single curve, as shown in FIG. 10, or a double-curved, "S" shape, as shown in FIG. 7. The latter shape may be used to move the return force further from the pivot point of the blade unit to better balance the blade unit during shaving. Other configurations and curve geometries are possible which provide acceptable flexing characteristics, functionality and ease of manufacturability and assembly.

Figure 4:
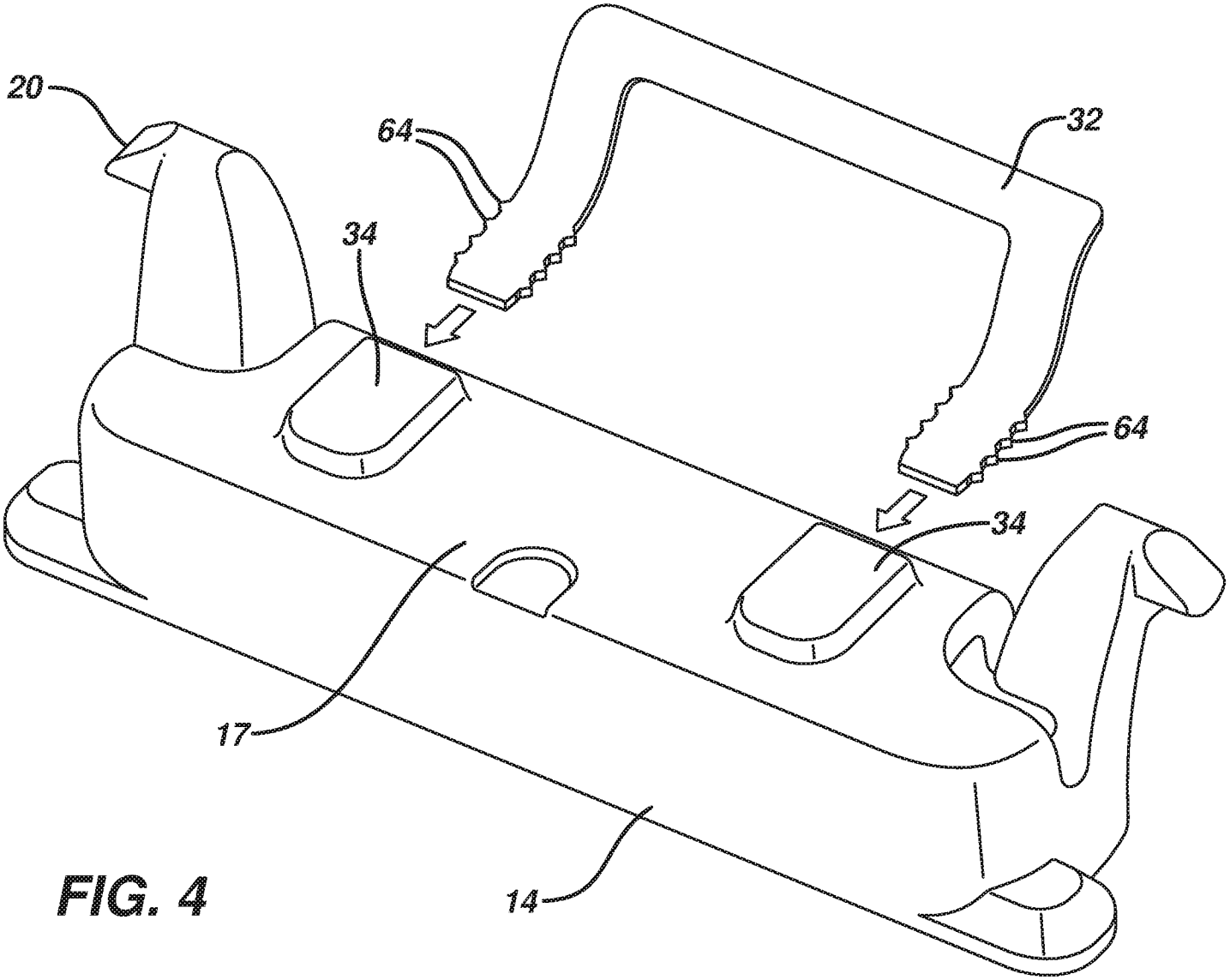
FIG. 4 is an exploded view of the assembly shown in FIG. 3.
Figure 5:
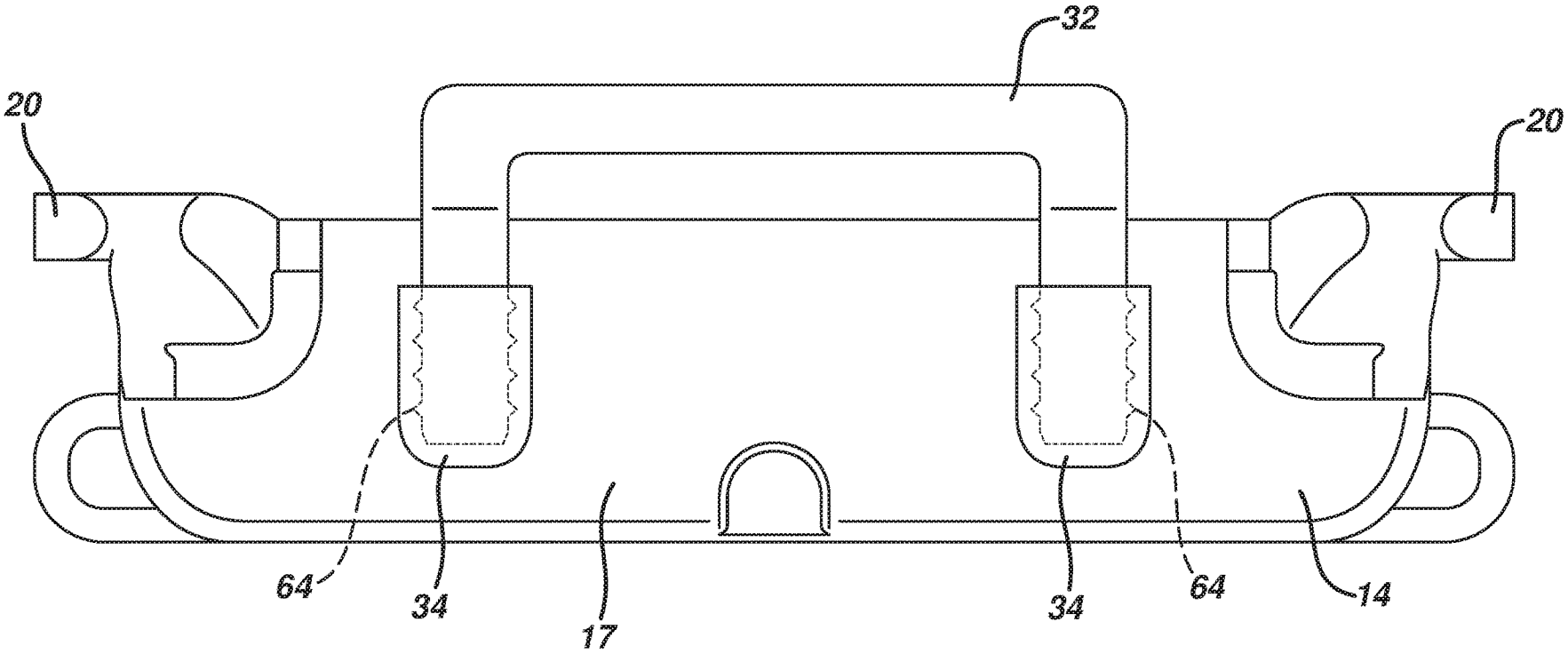
FIG. 5 is a plan view of the underside of the assembly shown in FIG. 3, with the attachment features in phantom.
Figure 6:
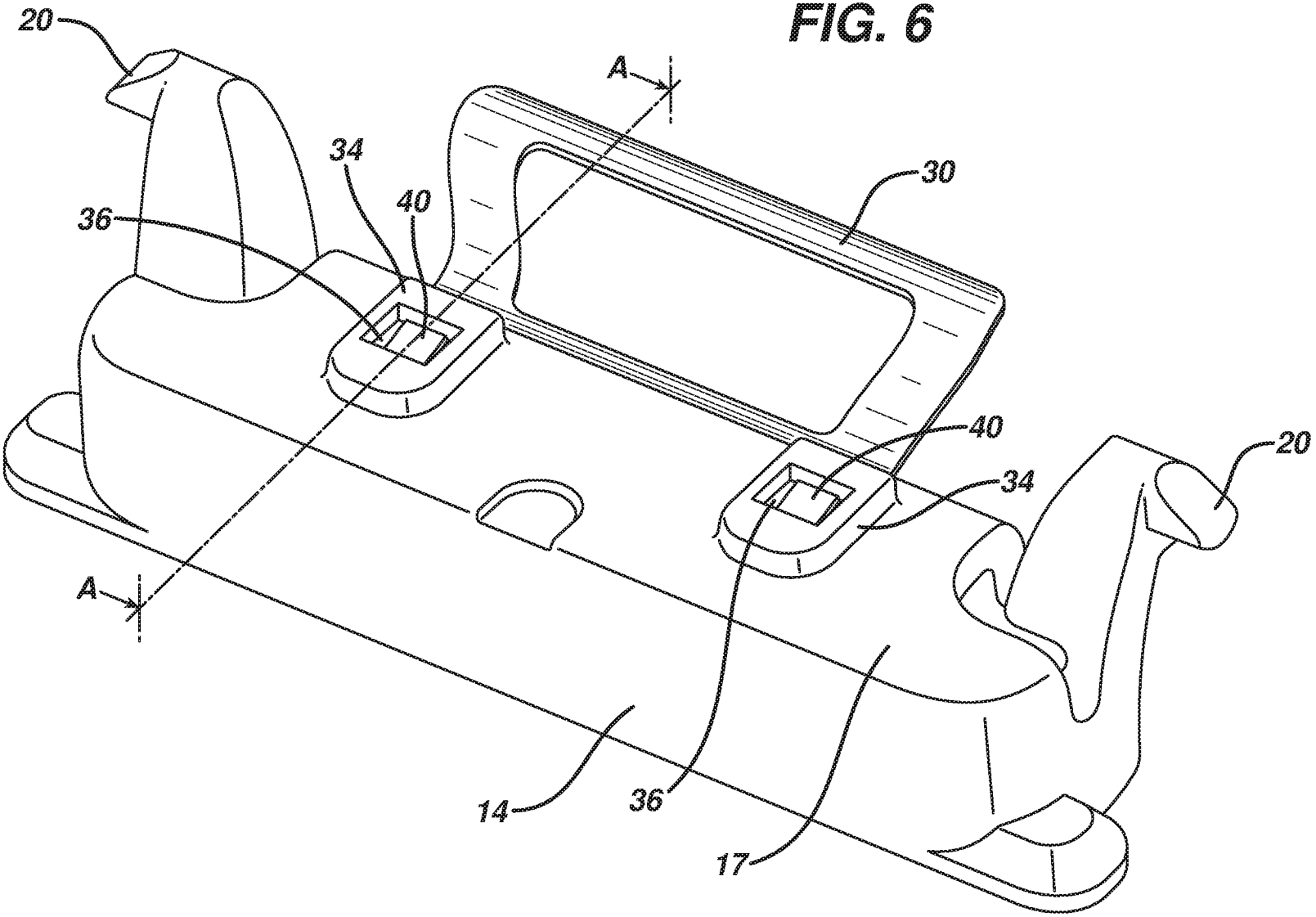
FIG. 6 is a perspective view of the underside of an interface element/return element assembly according to another embodiment.
Figure 11:
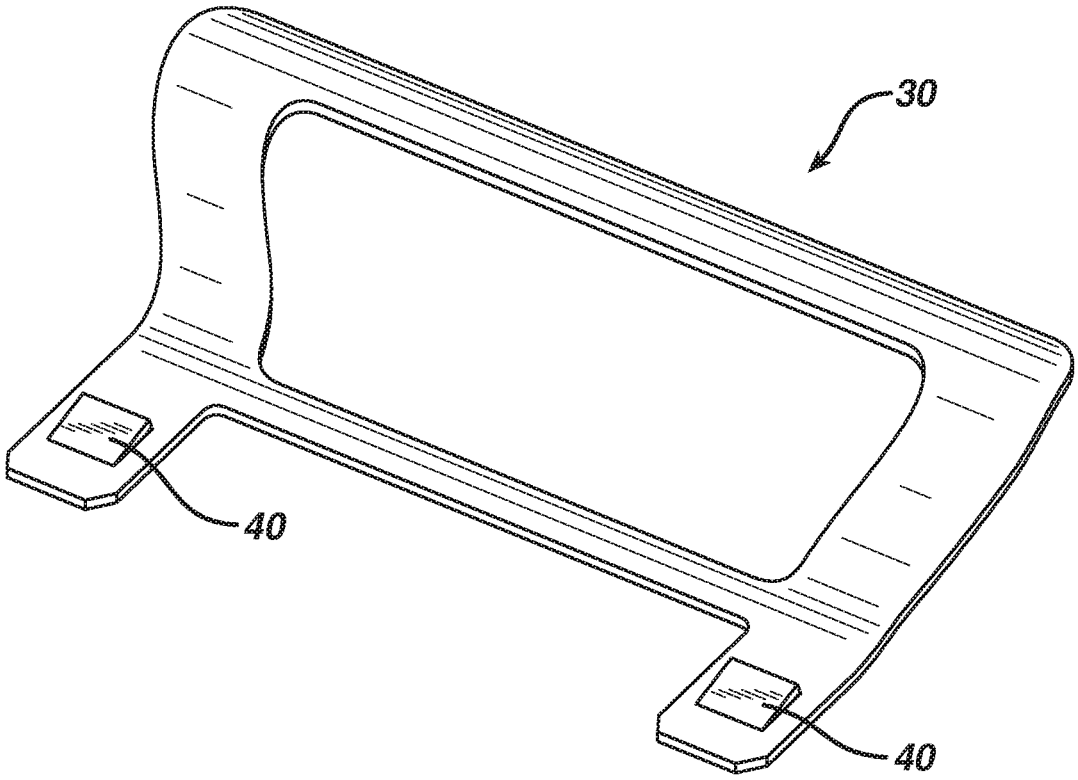
FIG. 11 is a perspective view of the return element shown in FIG. 6.
Figure 12:
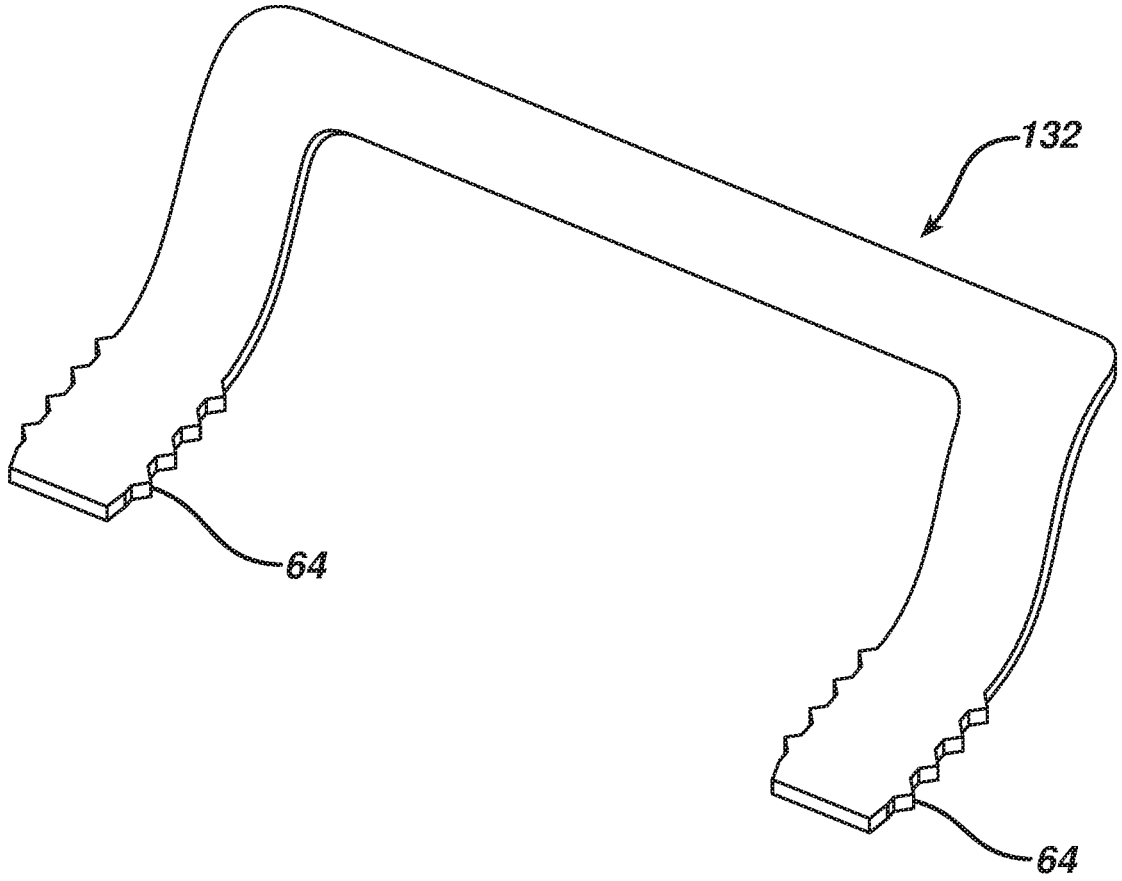
FIG. 12 is a perspective view of the return element shown in FIG. 4.

Referring to FIGS. 4 and 5, the return element 30 has a series of protrusions 64 which extend from its terminal aspects. The terminal aspects of the return element are configured to be received in complementary shaped recesses 34 on the bottom surface 17 of interface element 14. Protrusions 64 allow the return element to be easily and permanently affixed to the interface element 14. Alternate modes of affixing the return element to the interface element are possible. For example, referring to FIGS. 6, 7 and 11, tabs 40 could be configured at the terminal ends of the return element 30. Recesses 34 are configured with openings 36 which receive tabs 40, permanently affixing the return element 30 to the interface element 14.

Figure 8:
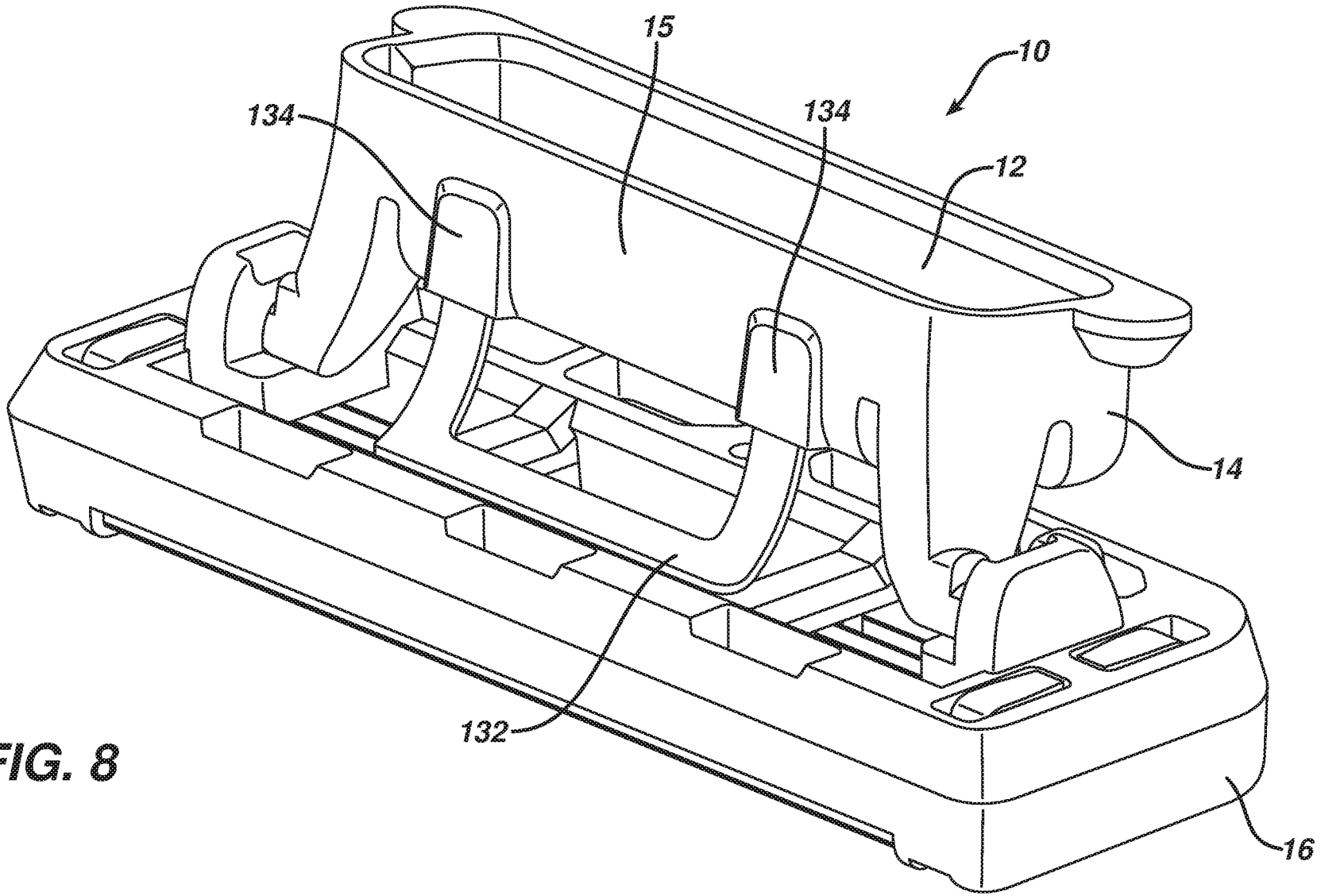
FIG. 8 is a perspective view of a shaving assembly according to an alternate embodiment.
Figure 9:
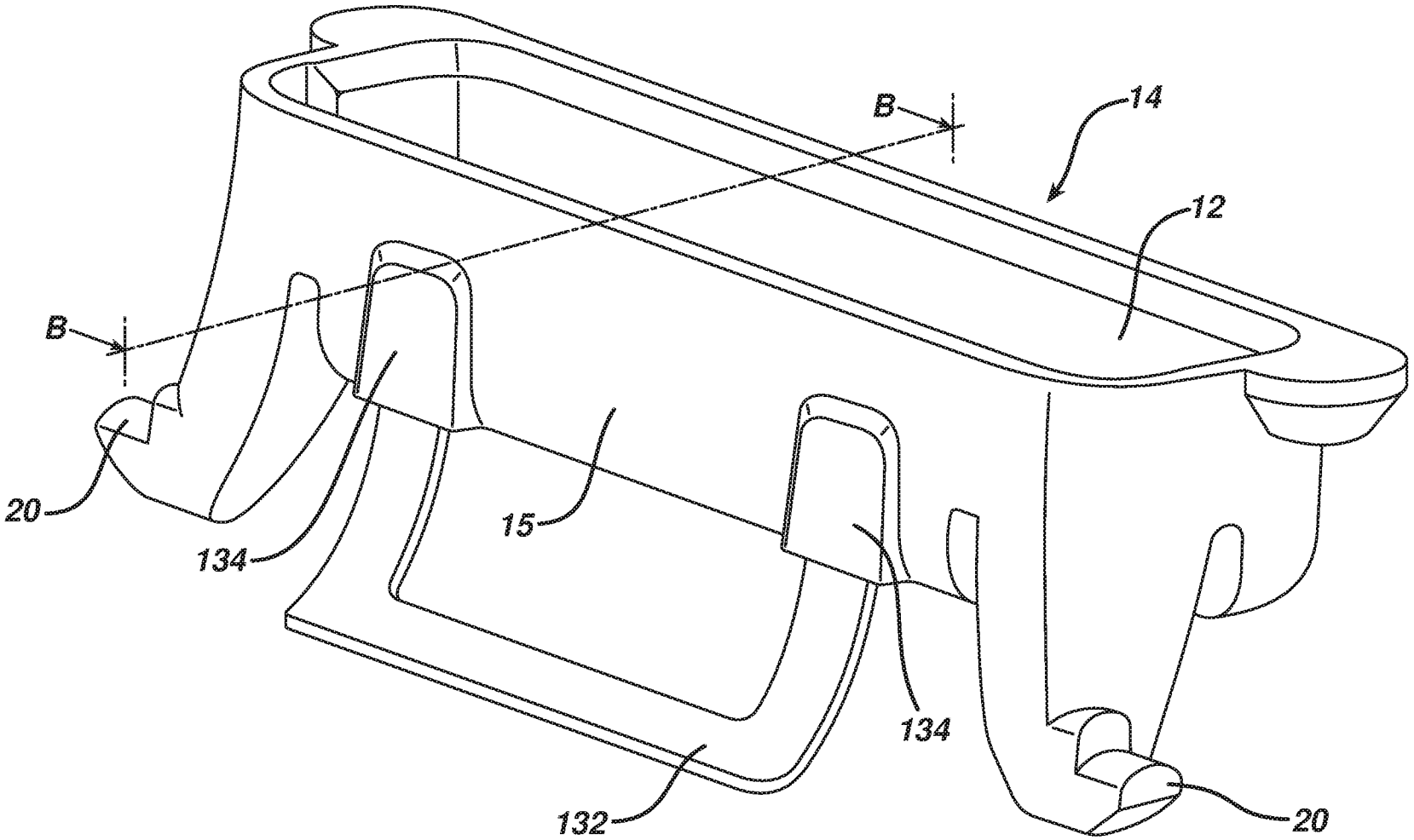
FIG. 9 is a perspective view of the interface/return element assembly shown in FIG. 8.

Referring to FIGS. 8, 9, and 10, complementary shaped recesses 134 are configured on front surface 15 of the interface element 14, rather than on bottom surface 17. This alternative configuration is designed to accommodate an alternatively shaped return element 132. Return element 132 may be attached to the interface element 14 in any of the manners previously discussed.

In all of the embodiments discussed herein, the return element is designed such that its geometry and other characteristics provide an applied load as assembled that is sufficient to overcome the friction of the system at rest (pretensioned load), typically at least 5 grams, e.g., 5 to 40 grams, and a load during shaving of from about 10 to 110 grams. Preferably, the return element is formed of a material that has a spring rate that provides a relatively high preload and a relatively low spring rate during shaving. The return element is preferably constructed of a metal alloy, e.g. stainless steel, carbon strip steel, nickel plated alloy, nickel chromium alloy, or other alloys, such that it resists corrosion and staining. The return element could be formed by stamping, metal injection molding or similar. In some implementations, the return element is formed of stainless steel, nickel-based alloy, high carbon strip, or similar. The return element may have a thickness of, e.g., from 0.05 to 4.0 mm. Advantageously, forming the return element from a metal alloy improves longevity and provides for a stable spring rate that will not change with repeated use. This is due, in part, because the material is forgiving and offers consistent bending characteristics.

The interface element and handle can be formed, for example, from a non-elastomeric thermoplastic material such as acetyls (e.g., POM), polyvinyl chloride (PVC), high impact polystyrene (PS), polypropylene (PP), polyethylene (PE) (high and low density), ABS. Preferred materials have sufficient rigidity to provide the desired degree of lateral stability to the shaving assembly.

OTHER EMBODIMENTS

A number of embodiments have been described. Nevertheless, it will be understood that various modifications may be made without departing from the spirit and scope of the disclosure.

For example, the return element can be dimensioned to provide for preferred flexing areas. In some implementations, the return element may include a notch, groove, weakened or strengthen cross-sectional region, or the like, to provide an area for preferential flexing.

Also, while removable shaving assemblies have been discussed above, in some implementations the shaving system is designed to be disposable as a whole. In these cases, the shaving assembly is affixed to the handle in a manner that is not intended for the consumer to remove, e.g., by fixedly mounting the interface element on the distal end of the handle. This may be accomplished, for example, by engagement of corresponding mechanical locking features on the handle and interface element, by welding (e.g., ultrasonic welding), by molding the interface element integrally with the handle, or by any other desired mounting technique.

In another embodiment, the return element may be affixed to the interface element in any suitable mechanical or chemical manner. For example, an adhesive may be used to join the elements into one unit or, an over-molding technique may be used to mold the interface element over the return element to form one unit.

Other embodiments may feature alternative mounting points for the return element. For example, the return element may be mounted to any surface or aspect of the interface element such that the desired functionality and manufacturability is achieved.

Accordingly, other embodiments are within the scope of the following claims.

What is claimed is:

1. A replaceable shaving assembly comprising:

an interface element having a cavity dimensioned to receive a distal end of a handle, and having integrally formed first pivot elements, a blade unit pivotably mounted to the interface element by way of pivoting engagement between the first pivot elements and corresponding second pivot elements on the blade unit, and a return element mounted on the interface element, the return element comprising a metal leaf spring including a pair of spaced first and second portions, each of the first and second portions extending along its length from the interface element towards the blade unit in a direction generally perpendicular to a longitudinal axis of the blade unit, joined by a third portion disposed generally parallel to the longitudinal axis, wherein each of the first and second portions is curved in a lateral direction along its length, whereby a force applied by the blade unit to the first and second portions will cause the first and second portions to bend laterally about a pivot axis that is generally parallel to the longitudinal axis to provide a return force between the blade unit and the interface element.

2. The shaving assembly of claim 1, wherein the return element is configured to bias the blade unit towards a rest position with respect to a pivot axis about which the blade unit pivots, the pivot axis being generally parallel to the longitudinal axis of the blade unit.

3. The shaving assembly of claim 1, wherein the return element comprises metal alloy.

4. The shaving assembly of claim 1, wherein the return element is formed from a sheet material having a thickness of from about 0.05 to 4.0 mm.

5. The shaving assembly of claim 1, wherein the interface element includes receiving openings and the return element includes mounting tabs disposed in the receiving openings.

6. The shaving assembly of claim 1 wherein the first pivot elements on the interface element comprise outwardly extending fingers that are received by the corresponding second pivot elements on the blade unit.

7. The shaving assembly of claim 1 further comprising a pivot stop formed integrally with the blade unit.

8. A shaving system comprising:

a handle having a distal end and a proximal end; and a shaving assembly mounted on the distal end of the handle, the shaving assembly including (a) an interface element having a cavity that receives the distal end of the handle, and having integrally formed first pivot elements, (b) a blade unit pivotably mounted to the interface element by way of pivoting engagement between the first pivot elements and corresponding second pivot elements on the blade unit, and (c) a return element mounted on the interface element, the return element comprising a metal leaf spring including a pair of spaced first and second portions, each of the first and second portions extending along its length from the interface element towards the blade unit in a direction generally perpendicular to a longitudinal axis of the blade unit, joined by a third portion disposed generally parallel to the longitudinal axis, wherein each of the first and second portions is curved in a lateral direction along its length, whereby a force applied by the blade unit to the first and second portions will cause the first and second portions to bend laterally about a pivot axis that is generally parallel to the longitudinal axis to provide a return force between the blade unit and the interface element.

9. The shaving system of claim 8, wherein the return element is configured to bias the blade unit towards a rest position with respect to a pivot axis about which the blade unit pivots, the pivot axis being generally parallel to the longitudinal axis of the blade unit.

10. The shaving system of claim 8, wherein the return element comprises metal alloy.

11. The shaving system of claim 8, wherein the return element is formed from a sheet material having a thickness of from about 0.05 mm to 4.0 mm.

12. The shaving system of claim 8, wherein the interface element includes receiving openings and the return element includes mounting tabs disposed in the receiving openings.

13. The shaving system of claim 8, wherein the return element is configured to bend upon rotation of the blade unit toward an upper surface of the handle.

14. The shaving system of claim 8, wherein the first pivot elements on the interface element comprise outwardly extending fingers that are received by the corresponding second pivot elements on the blade unit.

15. The shaving system of claim 8 further comprising a pivot stop formed integrally with the blade unit.

16. A method of shaving comprising contacting the skin with a blade unit of a shaving system that includes (a) a handle having a distal end and a proximal end, and (b) pivotably mounted on the handle, a replaceable shaving assembly that includes (i) an interface element having a cavity that receives the distal end of the handle, and having integrally formed first pivot elements, (ii) a blade unit pivotably mounted to the interface element by way of pivoting engagement between the first pivot elements and corresponding second pivot elements on the blade unit, and (iii) a return element mounted on the interface element, the return element comprising a metal leaf spring including a pair of spaced first and second portions, each of the first and second portions extending along its length from the interface element towards the blade unit in a direction generally perpendicular to a longitudinal axis of the blade unit, joined by a third portion disposed generally parallel to the longitudinal axis, wherein each of the first and second portions is curved in a lateral direction along its length, whereby a force applied by the blade unit to the first and second portions will cause the first and second portions to bend laterally about a pivot axis that is generally parallel to the longitudinal axis to provide a return force between the blade unit and the interface element.

* * * * *